US005570480A

United States Patent [19]

Yeung

[11] Patent Number: 5,570,480

[45] Date of Patent: Nov. 5, 1996

[54] INFLATABLE FLOATING SPA

[75] Inventor: Man F. Yeung, Rowland Heights, Calif.

[73] Assignee: Sunco Products, Inc., Industry, Calif.

[21] Appl. No.: 492,375

[22] Filed: Jun. 19, 1995

[51] Int. Cl.[6] ..... E04H 4/12

[52] U.S. Cl. ..... 4/487; 4/588; 441/37; 441/130; 441/131; 114/346

[58] Field of Search ..... 4/487, 541.5, 585, 4/588, 590; 441/87, 130, 131, 86, 135, 40, 41, 43, 129, 108, 113; 114/345, 346

[56] References Cited

U.S. PATENT DOCUMENTS

| | | | |
|---|---|---|---|
| 3,571,819 | 3/1971 | Puncochar | 4/487 |
| 4,023,220 | 5/1977 | Younker | 4/585 |
| 4,126,905 | 11/1978 | Russell et al. | 4/487 |
| 4,135,256 | 1/1979 | Limegrower | 4/487 |
| 4,149,281 | 4/1979 | Bob et al. | 4/487 |
| 4,383,564 | 5/1983 | Hole | 4/585 |
| 4,706,307 | 11/1987 | Smith | 4/487 |
| 4,976,642 | 12/1990 | Wilkie | 441/131 |

FOREIGN PATENT DOCUMENTS

| | | | |
|---|---|---|---|
| 2108435 | 5/1983 | United Kingdom | 441/130 |

*Primary Examiner*—Henry J. Recla
*Assistant Examiner*—Charles R. Eloshway
*Attorney, Agent, or Firm*—Dominik & Stein

[57] ABSTRACT

An inflatable floating spa for use in water by a person to recline and rest therein that is formed from a resilient material and comprises an air chamber that provides support for suspended upper and lower water chambers which remain submerged and a sheet means that is interposed between the upper and lower water chambers forming a seat.

8 Claims, 2 Drawing Sheets

INFLATABLE FLOATING SPA

BACKGROUND OF THE INVENTION

1. Field of the Invention

This invention relates to a floating spa and, more particularly, to an inflatable floating spa to be used by a plurality of persons while reclining in water.

2. Description of the Background Art

Presently, many types of floating spas are known and are in wide use today throughout the water-related industry. Many of the prior art floating spas are of a rigid structural design which limits their ability to be picked up and moved from one location to another. The structurally rigid floating spas are generally designed to be kept in one location and not portable. In addition, many of the prior art floating spas are complicated and require extensive set-up and assembly. Other prior art floating spas are heavy and cumbersome and require electricity to operate.

Typical examples of current floating spas are disclosed in the following patents: U.S. Pat. Nos. 4,754,502; 4,706,307; 4,149,281; 4,135,256; 4,126,905; and 3,571,819, the disclosures of which are hereby incorporated by reference herein.

None of the floating spas or pools disclosed in the above-referenced U.S. Patents overcome the inadequacies as discussed above. More particularly, U.S. Pat. No. 4,754,502, issued to Bowen, discloses an inflatable bath wherein several chambers are interconnected through which a heated steam is to flow and provide the floating support for the inflatable bath. The Bowen invention requires the use of a steam generator as well as a motor driven water pump and filter used to recirculate the water within the inflatable bath. In addition, the Bowen invention does not provide a person with the means for reclining or resting therein.

In U.S. Pat. No. 4,706,307, issued to Smith, the disclosure describes a floating pool assembly wherein an extensive assembling procedure is required for setting up and using the floating pool assembly. Further, the disclosed invention according to Smith does not provide a person with a means for reclining or resting therein.

Therefore, it is an object of this invention to provide an improvement which overcomes the aforementioned inadequacies of the prior art devices and provides an improvement which is a significant contribution to the advancement of the floating spa art.

Another object of this invention is to provide an inflatable floating spa that incorporates a built-in seat for persons to recline and rest upon while remaining inside.

Another object of the present invention is to provide an inflatable floating spa having a transparent sheet means that facilitates the viewing of underwater activities.

Another object of the present invention is to provide an inflatable floating spa that is lightweight and easily transported to other locations for use after deflating and folding up thereof.

Another object of the present invention is to provide an inflatable floating spa that is generally of a one-piece construction so as to thereby eliminate any requirement of assembly before use. Simple inflation of the air chamber and filling of the upper and lower water chambers with water are the only set-up steps required.

Another object of the present invention is to provide an inflatable floating spa that incorporates drain holes for allowing the free flow of water into and out of the floating spa.

Another object of the present invention is to provide an inflatable floating spa that allows access into said spa through the top or through the bottom thereof.

Another object of the present invention is to provide an inflatable floating spa for use in water by persons to recline and rest therein, the inflatable floating spa comprising in combination: a floatation means for supporting the inflatable floating spa, the floatation means having a submerged side and a top side; an upper water chamber, the upper water chamber being coupled to the floatation means along the submerged side; a sheet means for providing a seat within the inflatable floating spa being coupled to and extending downward from the upper water chamber, the sheet means including a center hole having an internal perimeter edge; and a lower water chamber coupled to and along the internal perimeter edge of the center hole, the lower water chamber being tubular in nature thereby defining an opening, whereby the upper and lower water chambers are filled with water and remain submerged while the floatation means remains afloat on top of the water thereby supporting the upper and lower water chambers suspended downward therefrom under the water.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention comprises an inflatable floating spa that is generally formed into a one piece unit and is inflated for use. More particularly, the inflatable floating spa of the invention comprises an air chamber being tubular in nature for supporting the floating spa and suspending therefrom a upper water chamber which is tubular in nature, a sheet means for providing a seat, and a lower water chamber that is tubular in nature and defines an opening therein.

The sheet means for providing a seat within the inflatable floating spa is of a transparent material so to facilitate the viewing of activities underneath the water. The sheet means further comprises a plurality of drain holes that serve to allow the free flow of water into and out of the inflatable floating spa.

The lower water chamber having the defined opening within, serves to support the persons legs that extend therethrough while reclining and resting within the inflatable floating spa. The reclining aspect associated with the present invention is provided by way of the sheet means being coupled to and interposed between the upper and lower water chambers which in effect forms a seat.

Upon completing use of the inflatable floating spa, simple deflating of the air chamber and emptying of the upper and lower water chambers allows the folding thereof for easy removal and storage.

An important feature of the present invention is that the inflatable floating spa is lightweight and can be deflated and folded quickly requiring little storage space.

Another important feature of the present invention is that the inflatable floating spa is generally of a one-piece unit requiring no assembly prior to use. Simple inflation of the air chamber and filling of the water chambers is all that is required.

Another important feature of the present invention is that the inflatable floating spa incorporates a built-in seat for a person to recline and rest upon while using the spa.

Therefore, it can be readily appreciated that the present invention overcomes the disadvantages associated with the prior art and greatly simplifies the required assembly and set-up procedures associated with the prior art before use.

The foregoing has outlined rather broadly the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE PREFERRED EMBODIMENT

Figure 1:
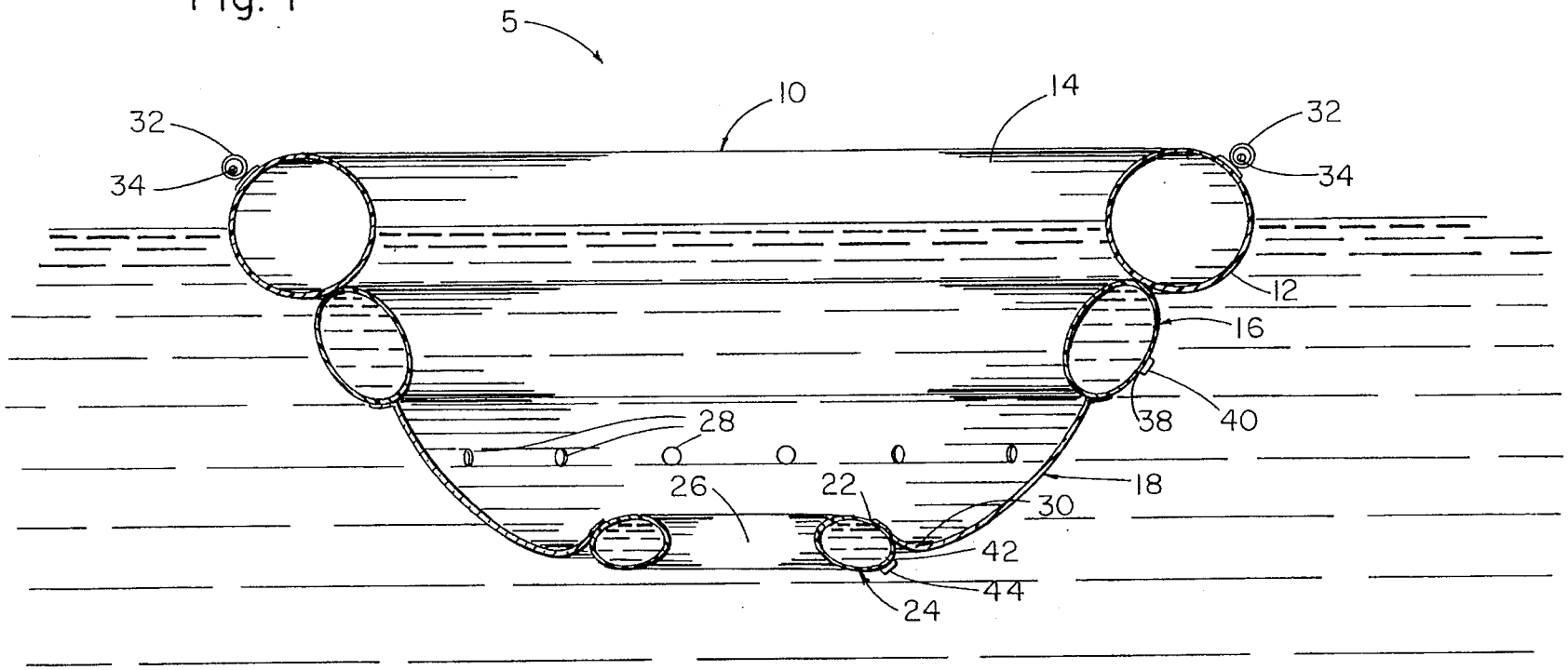
FIG. 1 is a cross-sectional side view of the inflatable floating spa showing the air chamber, the upper water chamber, the lower water chamber, and the transparent sheet means in their relative positions.

Referring to FIG. 1, a cross-sectional side view of the inflatable floating spa 5 is shown illustrating the relative positions of the air chamber 10 having a submerged side 12 and a top side 14, an upper water chamber 16, a sheet means 18 having a center hole and an internal perimeter edge 22, and a lower water chamber 24 which defines an opening 26 therein.

The inflatable floating spa 5 is supported solely by the air chamber 10 which is inflated with air and remains afloat on top of the water. The air chamber 10 is preferably formed from a resilient poly vinyl chloride material that is non-water permeable. The upper water chamber 16 is coupled to the submerged side 12 of the air chamber 10. The upper water chamber 16 is preferably heat-sealed to and along the submerged side 12 of the air chamber 10 so to coincide therewith and form a similar circular shape. The air chamber 10 and the upper water chamber 16 are both tubular in nature and are continuous so as to form a circular ring-like configuration being open within the center. The upper water chamber 16 serves to provide rigidity to the overall inflatable floating spa 5 as well as support for users' backs while reclining therein.

Next, the sheet means 18 is heat-sealed to and along the upper water chamber 16 so as to suspend downward therefrom. The sheet means 18 is preferably formed form a transparent resilient poly vinyl chloride material that is non-water permeable. The sheet means 18 further includes a center hole having an internal perimeter edge 22.

The lower water chamber 24 is coupled to and along the internal perimeter edge 22 of the center hole. The lower water chamber 24 is tubular in nature, similar to the air chamber 10 and the upper water chamber 16, thereby forming a circular ring-like configuration having an opening 26 therethrough. The lower water chamber 24 is preferably made from a resilient poly vinyl chloride material that is non-water permeable.

Figure 2:
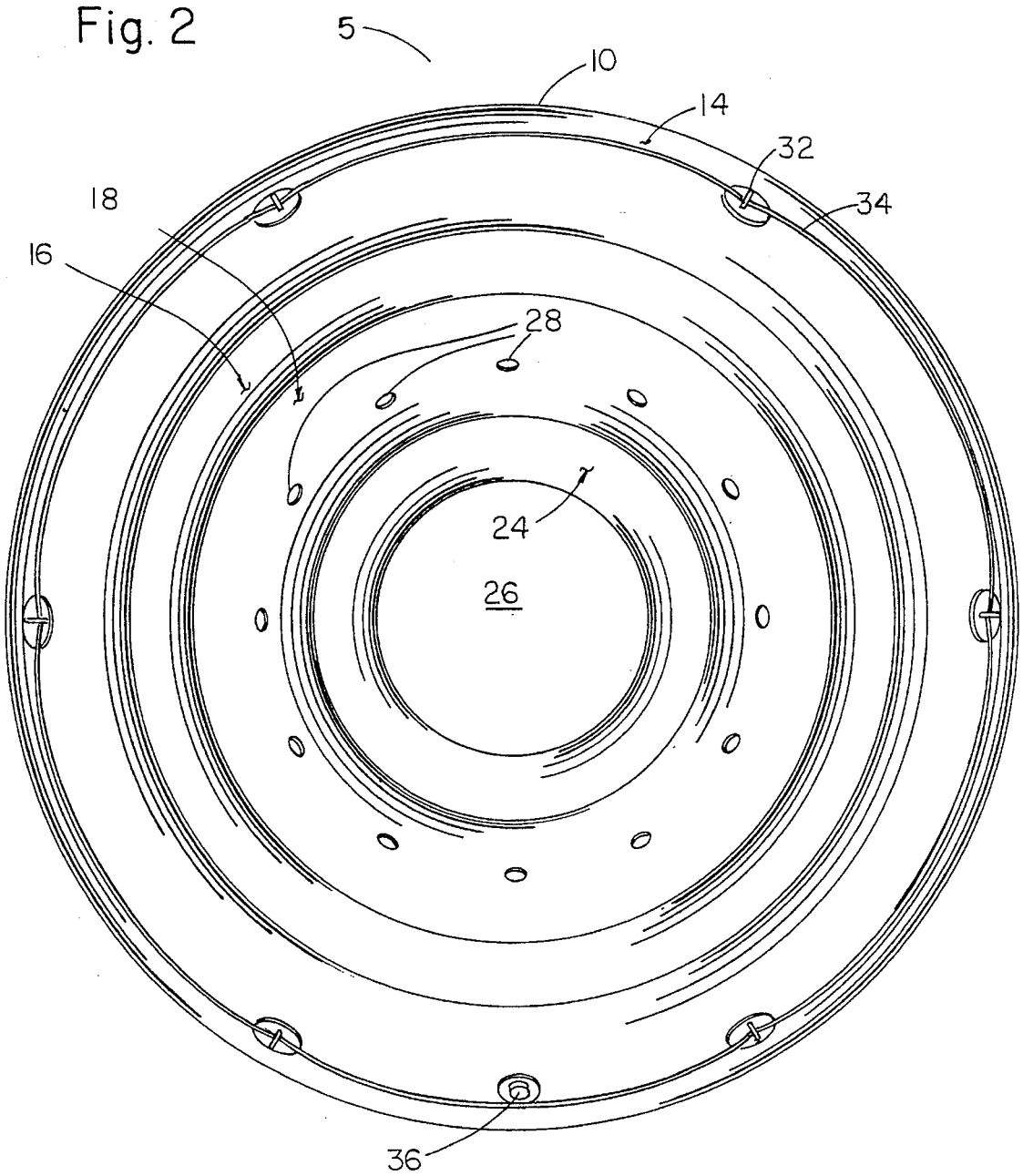
FIG. 2 is a top view of the inflatable floating spa showing the relative positions of the various chambers as well as the satellite eyelets and associated grab rope in their relative positions.

In now referring to FIG. 2, a top view of the inflatable floating spa 5 is shown further illustrating the sheet means 18 that includes a plurality of drain holes 28 which facilitate the free flow of water into and out of the inflatable floating spa 5. In addition, referring back to FIG. 1 in conjunction with FIG. 2, a seat 30 can be seen as integrally formed from the combination of the upper water chamber 16, the sheet means 18 and the lower water chamber 24.

Further illustrated in FIG. 2, the air chamber 10 is shown to include a plurality of satellite eyelets 32 that are positioned about and coupled to the top side 14 of the air chamber 10. A grab rope 34 is removably coupled to the satellite eyelets 32 by way of being threaded therethrough. Thus, the grab rope serves as a hand-hold and tie-up.

In operation, the inflatable floating spa 5 is unfolded and spread-out so that the air chamber 10 can be inflated with air. Air is introduced into the air chamber 10 by way of an air valve 36 which is coupled to the air chamber 10. Once the air chamber 10 has been inflated, the upper water chamber 16 is then filled with water by way of a first fill hole 38 having a first cap 40. The first fill hole 38 is closed by way of the first cap 40 being snapped in place after the upper water chamber 16 is filled with water. The lower water chamber 24 is then filled with water in a similar manner by way of a second fill hole 42 having a second cap 44 and the second fill hole 42 is closed by way of snapping in place the second cap 44.

The air valve 36 positioned on the air chamber 10 is of a conventional type commonly used in the industry. The first fill hole 38 and associated first cap 40 and the second fill hole 42 and associated second cap 44 are of the conventional fill hole and cap assemblies used commonly in the industry today. The air valve 36, first fill hole 38 and second fill hole 42 are all preferably heat-sealed to their respective chambers 10, 16 and 24.

In use, the air chamber 10 remains afloat on top of the water with the remaining upper water chamber 16, sheet means 18, and lower water chamber 24 being suspended downward therefrom and submerged. The inflatable floating spa 5 can be entered from on top of the water by climbing over the air chamber 10 or, alternatively, by swimming under the water and swimming up through the opening 26 formed by the lower water chamber 24. When reclining within the inflatable floating spa 5, a user is able to rest in a sitting position which is provided by the combination of the upper water chamber 16, the sheet means 18 and the lower water chamber 24. The sheet means 18 provides a seat 30 and the lower water chamber 24 serves as a support for a person's legs which are preferably dangling thereover and through the opening 26. The upper water chamber 16 serves as a comfortable support for the person's back while in a reclining position.

When the inflatable floating spa 5 is not being used, the upper and lower water chambers 16 and 24 are drained of water and the air chamber 10 is deflated. Upon emptying of the upper and lower water chambers 16 and 24 and deflating the air chamber 10, the inflatable floating spa 5 can then be easily folded-up and stored away. In addition, with the inflatable floating spa 5 being of a relative light weight, the inflatable floating spa 5 is easily carried to its place of storage or to another location for use in the future.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An inflatable floating spa for use in water by persons to recline and rest therein, said inflatable floating spa comprising in combination:

a floatation means for supporting said inflatable floating spa, said floatation means having a submerged side and a top side;

a sheet means for providing a seat within said inflatable floating spa being coupled to and extending downward from said floatation means, said sheet means including a center hole having an internal perimeter edge; and a lower water chamber coupled to and along said internal perimeter edge of said center hole, said lower water chamber being tubular in nature thereby defining a central opening and said lower water chamber being sealed to retain water therein, whereby said opening facilitates the entering and exiting of said inflatable floating spa by the person from underwater, said lower water chamber being filled with water and remaining submerged while said floatation means remains afloat on top of the water thereby supporting said lower water chamber suspended therefrom under the water.

2. The inflatable floating spa as recited in claim 1, wherein said inflatable floating spa further comprises an upper water chamber coupled to said sheet means, said upper water chamber being coupled to said floatation means along said submerged side and said sheet means being coupled to and along said upper water chamber.

3. The inflatable floating spa as recited in claim 2, wherein said floatation means is comprised of an air chamber having a tubular shape so as to define an enclosed area within.

4. The inflatable floating spa as recited in claim 3, wherein said upper water chamber is tubular in nature and is smaller in diameter than said air chamber.

5. The inflatable floating spa as recited in claim 4, wherein said sheet means further includes drain holes positioned in the seat so as to facilitate the free flow of water into and out of said inflatable floating spa.

6. The inflatable floating spa as recited in claim 5, wherein said lower water chamber is of a smaller diameter than said air chamber and said upper water chamber, said lower water chamber and said sheet means forming a seat within said inflatable floating spa with said opening of said lower water chamber facilitating the passing of person's legs therethrough and said lower water chamber supporting the legs when the person is seated within.

7. The inflatable floating spa as recited in claim 6, wherein said air chamber further comprises a plurality of satellite eyelets positioned about and coupled to said top side for facilitating the passing of a grab rope therethrough that serves as a hand hold and tie-up.

8. The inflatable floating spa as recited in claim 7, wherein said sheet means is resilient and transparent.

* * * * *